US009837749B2

(12) United States Patent
Furuya et al.

(10) Patent No.: US 9,837,749 B2
(45) Date of Patent: Dec. 5, 2017

(54) CONNECTOR

(71) Applicant: Tyco Electronics Japan G.K., Kanagawa (JP)

(72) Inventors: Sumiyoshi Furuya, Kanagawa (JP); Shinji Amemiya, Kanagawa (JP); Fumito Nagashima, Kanagawa (JP)

(73) Assignee: Tyco Electronics Japan G.K., Kanagawa (JP)

( * ) Notice: Subject to any disclaimer, the term of this patent is extended or adjusted under 35 U.S.C. 154(b) by 0 days.

(21) Appl. No.: 15/440,452

(22) Filed: Feb. 23, 2017

(65) Prior Publication Data

US 2017/0244191 A1 Aug. 24, 2017

(30) Foreign Application Priority Data

Feb. 24, 2016 (JP) ..... 2016-033281

(51) Int. Cl.
*H01R 13/44* (2006.01)

(52) U.S. Cl.
CPC ..... *H01R 13/44* (2013.01)

(58) Field of Classification Search
CPC ..... H01R 13/44; H01R 13/514; H01R 13/62; H01R 13/422
USPC ..... 439/141, 140, 701, 157
See application file for complete search history.

(56) References Cited

U.S. PATENT DOCUMENTS 5,344,347 A * 9/1994 Inoue ..... H01R 13/193 439/701
5,913,703 A * 6/1999 Suzuki ..... H01R 13/518 439/489
6,846,191 B2 * 1/2005 Hobbs ..... H01R 13/4538 439/140
6,896,531 B2 * 5/2005 Bakker ..... H01R 13/4538 439/140
7,108,566 B2 * 9/2006 Kressmann ..... H01R 13/193 439/701

(Continued)

FOREIGN PATENT DOCUMENTS

JP 20030368401 A 3/2003

*Primary Examiner* — Alexander Gilman
(74) *Attorney, Agent, or Firm* — Barley Snyder

(57) ABSTRACT

An electrical connector having a highly reliable electric shock prevention mechanism.
The electrical connector has a housing, tab terminals, and a slidable member. The slidable member has engagement arms. The engagement arms have on forward sides fixed ends joined to a front side wall extending forward from an abutting wall, extend rearward in the form of cantilevers, and have hook portions. The hook portions engage with a mating electrical connector and this engagement causes the hook portions to be pulled by the mating electrical connector when the mating electrical connector in a mating state is extracted, so that the slidable member slides to a forward position. In addition, the housing is provided with anti-deflection walls. The anti-deflection walls allow the engagement arms to deflect so that the mating electrical connector can climb over the hook portions when the slidable member is located in the forward position. In addition, these anti-deflection walls prevent the engagement arms from deflecting when the slidable member is located near a rearward position rather than the forward position.

3 Claims, 8 Drawing Sheets

(56) References Cited

U.S. PATENT DOCUMENTS 7,347,710 B2 * 3/2008 Ohtaka ..... H01R 13/518 439/352
7,431,605 B2 * 10/2008 Dieterle ..... H01R 13/6272 439/358
8,002,570 B2 * 8/2011 Matsumura ..... H01R 13/631 439/141
8,033,856 B2 * 10/2011 Mito ..... H01R 13/518 439/358
8,147,261 B2 * 4/2012 Horiuchi ..... H01R 13/514 439/157
8,956,192 B2 * 2/2015 Eckel ..... H01R 13/44 439/686
8,998,653 B2 * 4/2015 Kamiya ..... H01R 13/62 439/701
9,004,954 B2 * 4/2015 Baldwin ..... H01R 13/46 439/680
9,054,454 B2 * 6/2015 Gomez ..... H01R 13/631
9,070,995 B2 * 6/2015 Yagome ..... H01R 13/44
9,099,808 B2 * 8/2015 Kato ..... H01R 13/4538
9,160,095 B2 * 10/2015 Littek ..... H01R 13/422
9,455,521 B2 * 9/2016 Bang ..... H01R 13/4538
9,502,812 B2 * 11/2016 Akagi ..... H01R 13/506
9,520,669 B2 * 12/2016 Gerwatowski ..... H01R 13/44
2003/0119349 A1 * 6/2003 Bakker ..... H01R 13/4538 439/140
2008/0119074 A1 * 5/2008 Okano ..... H01R 13/62938 439/140
2008/0132098 A1 * 6/2008 Tyler ..... H01R 13/62977 439/157
2010/0099295 A1 * 4/2010 Ohsumi ..... H01R 13/629 439/374

* cited by examiner

CONNECTOR

CROSS-REFERENCE TO RELATED APPLICATION

This application claims the benefit of the filing date under 35 U.S.C. §119 (a)-(d) of Japanese Patent Application No. 2016-0033281 filed on Feb. 24, 2016.

FIELD OF THE INVENTION

The present invention relates to an electrical connector provided with an electric shock prevention structure.

BACKGROUND

Some hybrid vehicles or electric vehicles use high voltage that instantaneously reaches as high as 1200V, for example. For this reason, an electrical connector to which such a high voltage is applied is provided with an electric shock prevention mechanism in order to prevent an operator who handles the connector from getting an electric shock.

In this regard, JP2003-068401A discloses a connector in which a slidable member for preventing contact with a male contact is provided inside a hollow portion in which the male contact is disposed, and the slidable member is provided with an engagement arm extending forward for engaging with a mating connector.

An electrical connector provided with such an electric shock prevention mechanism is required to have high reliability to ensure that the electric shock prevention mechanism is caused to function such that the operator or the like will never get an electric shock.

However, the aforementioned connector disclosed in JP2003-068401 does not ensure the engagement of the engagement arm with the mating connector with the slidable member located in a retreat position and poses a risk that the slidable member may not follow the mating connector to unmate.

SUMMARY

An electrical connector, constructed in accordance with the present invention, includes a housing having a hollow portion opened in a front side facing a mating electrical connector to be mated with the electrical connector and an anti-deflection portion. This electrical connector also includes a terminal supported by the housing and projecting forward into the hollow portion of the housing. An electrical connector, constructed in accordance with the present invention, further includes a slidable member disposed in the hollow portion of the housing and has an insertion hole in which the terminal is positioned. The slidable member is slidable between a forward position in which a front end of the terminal is in the insertion hole of the slidable member and a rearward position in which a portion of the terminal required for connection with a terminal of the mating electrical connector protrudes forward beyond the insertion hole. The slidable member also has an abutting wall formed with an insertion hole being pushed by the mating electrical connector when the mating electrical connector advances toward a mating abuts against the abutting wall. The slidable member also has a front side wall extending forward beyond the abutting wall of the slidable member and an engagement arm. The engagement arm of the slidable member has a cantilever shape having on a front side a fixed end joined to the front side wall of the slidable member. The engagement arm also has a hook portion adapted to engage the mating electrical connector when advancing toward the mating electrical connector, so that when the mating electrical connector in a mating state is extracted, the engagement causes the hook portion of the engagement arm to be pulled by the mating electrical connector and the hook portion causes the slidable member to slide to the forward position. The engagement arm is deflectable when within the anti-deflection portion of the housing allowing the engagement arm to deflect when the slidable member is located in the forward position, so that the mating electrical connector can climb over the hook portion of the engagement arm and prevent deflection of the slidable member when the slidable member is located rearward of the forward position.

The present invention, as summarized above, is an electrical connector having a highly reliable electric shock prevention mechanism.

DETAILED DESCRIPTION OF THE EMBODIMENT(S)

Hereinafter, an embodiment of the present invention will be described.

Figure 1:
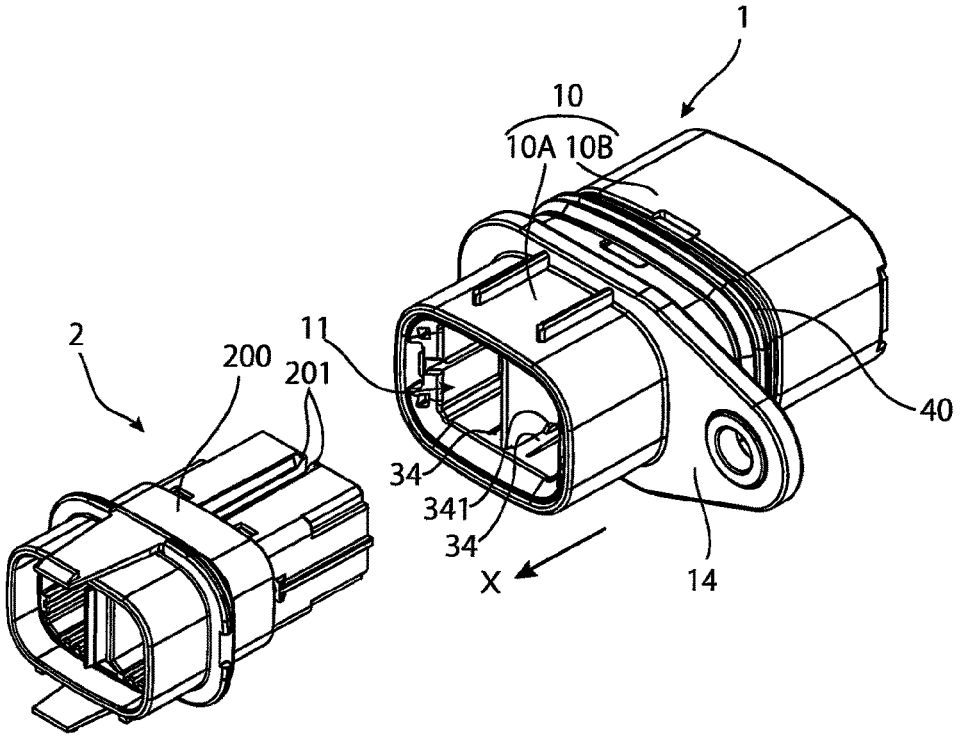
FIG. 1 is a perspective view of an electrical connector and a mating electrical connector that are mateable with each other according to the present invention.
Figure 3:
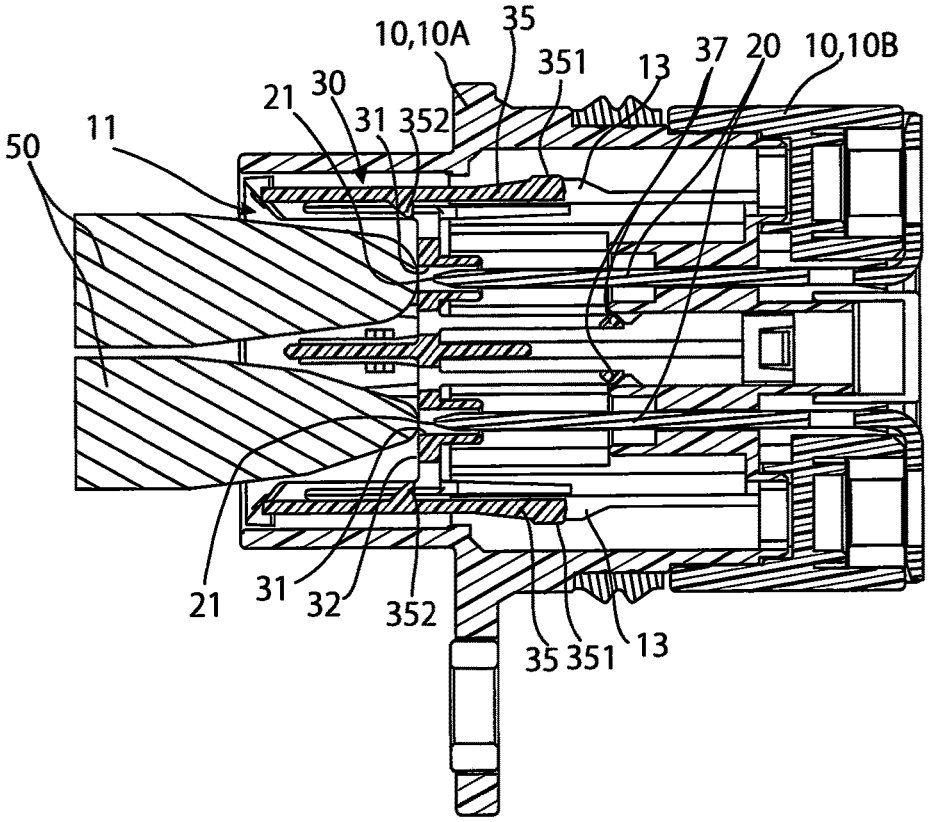
FIG. 3 is a plan view showing the same cross-section as the perspective view of FIG. 2.

FIGS. 1 and 3 show an electrical connector 1, constructed in accordance with the present invention, and a mating electrical connector 2 that are intended to mate with each other. In FIG. 1, the electrical connector 1 and the mating electrical connector 2 are shown poised for mating with each other as shown.

The electrical connector 1 is provided with a housing 10. This housing 10 has a hollow portion 11 opened in a front side facing the mating electrical connector 2 (in a direction of arrow X) intended to be mated with the electrical connector 1. This hollow portion 11 is fitted with a part of a housing 200 of the mating electrical connector 2. This fitting causes the electrical connector 1 and the mating electrical connector 2 to mate with each other.

The housing 10 is constituted by a combination of a front housing 10A and a rear housing 10B. The front housing 10A is provided with a waterproof seal ring 40 disposed along the outer periphery of the front housing 10A and the waterproof seal ring 40 is located near the rear housing 10B and rearward of a flange 14.

In FIG. 3, test fingers 50 are shown that represent human fingers and comply with safety standards.

The electrical connector 1 is also provided with two tab terminals 20 and a slidable member 30. The tab terminals 20 are positioned in the housing 10 by press-fit and thus supported by the housing 10. However, the tab terminals 20 may be fixed by another means. In addition, the tab terminals 20 protrude forward (in a direction of arrow X) into the hollow portion 11. In use, high voltage (for example, instantaneously, 1200V) is applied to the tab terminals 20. For this reason, an electric shock prevention mechanism is required so that a touch to the tab terminals 20 may not occur to cause an electric shock. These tab terminals 20 correspond to an example of a terminal referred to in the present invention.

Figure 2:
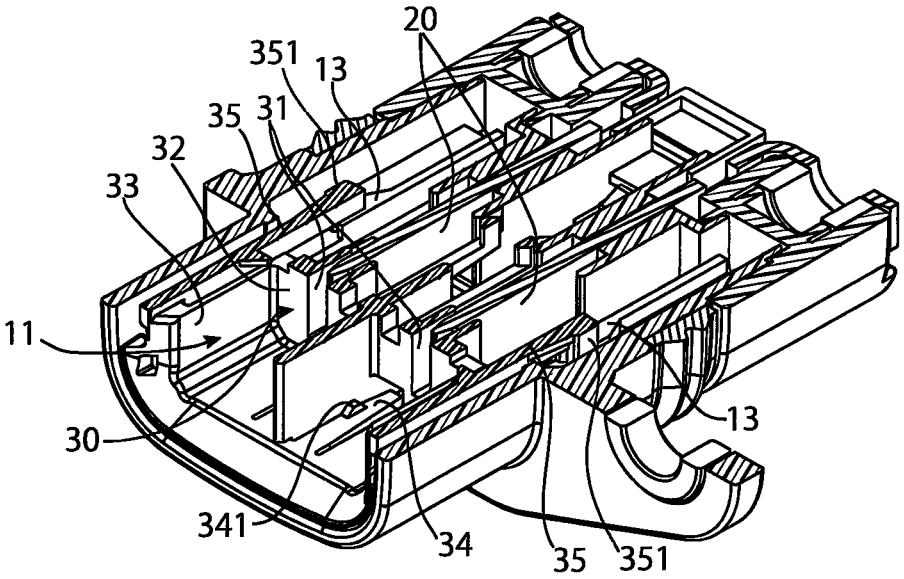
FIG. 2 is a perspective view in cross-section taken along a horizontal plane passing through the center of the electrical connector shown in FIG. 1.

In addition, the slidable member 30 is disposed in the hollow portion 11 and freely slides forward (in the direction of arrow X) and rearward (in the opposite direction of the arrow X). The position to which the slidable member 30 slides forward (in the direction of arrow X) is referred to as forward position. FIGS. 2 and 3 show the slidable member 30 in the forward position. The position to which the slidable member 30 slides rearward (in the opposite direction of arrow X) is referred to as rearward position. FIGS. 6(C), 7(C), and 8(C), described hereinafter, show the slidable member 30 in the rearward position.

The slidable member 30 and the housing 10 will be described with reference to FIGS. 2, 3, 4, and 5. The slidable member 30 is formed with two insertion holes 31. The two tab terminals 20 are inserted into these two insertion holes 31. When the mating electrical connector 2 (see FIG. 1) is not mated with the electrical connector 1, the slidable member 30 remains in the forward position as shown in FIGS. 2 and 3. In addition, when the slidable member 30 is located in the forward position, front ends 21 of the tab terminals 20 are withdrawn into the insertion holes 31 of the slidable member 30. Therefore, like the test fingers 50 shown in FIG. 3, a finger never touches the tab terminals 20 even if the finger gets into the hollow portion 11 of the housing 10. Thus, an electric shock is prevented.

When the slidable member 30 slides to the rearward position (see FIG. 6(C), FIG. 7(C), and FIG. 8(C)), longitudinal portions of the tab terminals 20 required for connection with female terminals 202 provided in the mating electrical connector 2 protrude forward beyond the insertion hole 31.

It is necessary to ensure that this electric shock prevention mechanism operates. To this end, it is important to ensure that the slidable member 30 slides to the forward position when the mating electrical connector 2 (see FIG. 1) is extracted from the electrical connector 1. In order to achieve this result, this embodiment of the present invention includes a mechanism described below.

As shown in FIGS. 2, 3, 4(A), and 4(B), the slidable member 30 is provided with an abutting wall 32 and a front side wall 33. The abutting wall 32 is a wall formed with the insertions holes 31 for abutting on the mating electrical connector 2 in the process of mating and being pushed by the mating electrical connector 2. In addition, the front side wall 33 is a wall extending forward beyond the abutting wall 32, in this embodiment, like a hood. In addition, the slidable member 30 is provided with two engagement arms 34 for each of top and bottom portions. These engagement arms 34 have on their front sides fixed ends joined to the front side wall 33, and extend rearward in the form of cantilevers. In addition, the engagement arms 34 are provided with hook portions 341 (see FIGS. 6(A), 6(B), and 6(C)) disposed closer to a rear end side than the fixed ends and forward of the abutting wall 32 in this embodiment and protrude inward for engaging with the mating electrical connector 2 advancing toward the mating. The hook portions 341 have a function of engaging with engaging portions 201 (see FIGS. 1 and 6) of the mating electrical connector 2, thereby being pulled by the second mating connector 2 to cause the slidable member 30 to slide forward when the mating electrical connector 2 in the mating state is extracted.

The engagement arms 34 are prevented from deflecting by anti-deflection walls 12 (see FIG. 5) of the housing 10 when the slidable member 30 is located rearward of the forward position. In addition, the engagement arms 34 are detached from the anti-deflection wall 12 and allowed to deflect when the slidable member 30 is located in the forward position. The details of this point will be described hereinafter. The anti-deflection wall 12 is an example of an anti-deflection portion of the present invention.

As shown in FIGS. 2, 3, 4(A), and 4(B), the slidable member 30 is provided with a lock arm 35 on each of right and left sides. These lock arms 35 have on their front sides fixed ends joined to the front side wall 33 and extend in the form of cantilevers rearward beyond the abutting wall 32. In addition, the lock arms 35 have slidable-member-side engaging portions 351 located rearward of the abutting wall 32. The housing 10 is formed with housing-side engaging portions 13 (see FIGS. 2, 3, and 5). When the slidable member 30 is located in the forward position, the slidable-member-side engaging portions 351 provided in the lock arms 35 engage with the housing-side engaging portions 13, and the slidable member 30 is thus locked in the forward position. This lock prevents the slidable member 30 from retreating even if the slidable member 30 is pushed rearward by a force of 10 Newtons, for example.

Figure 4A:
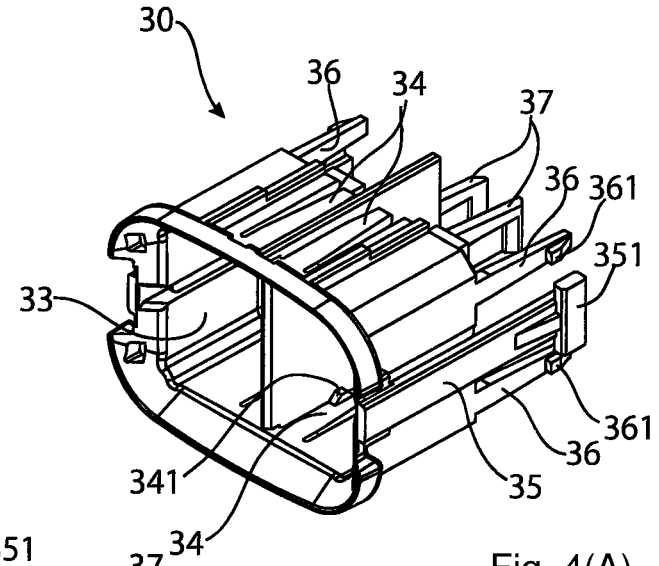
FIG. 4(A) is a perspective view of a slidable member and FIG. 4(B) is a perspective view in cross-section taken along a horizontal plane passing through the center of the slidable member.
Figure 4B:
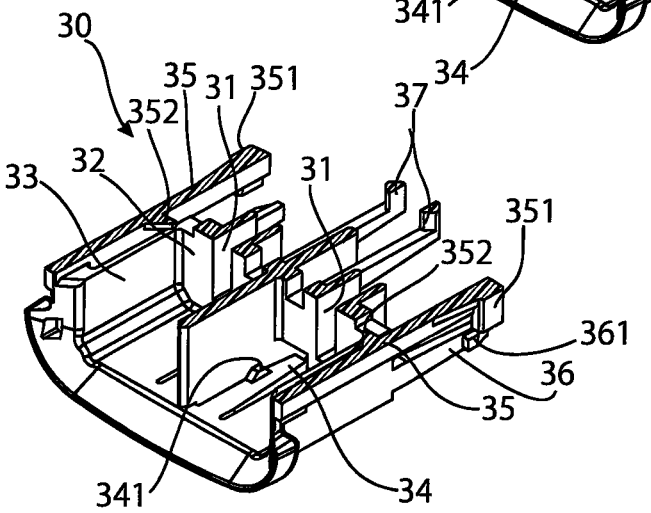
Figure 5:
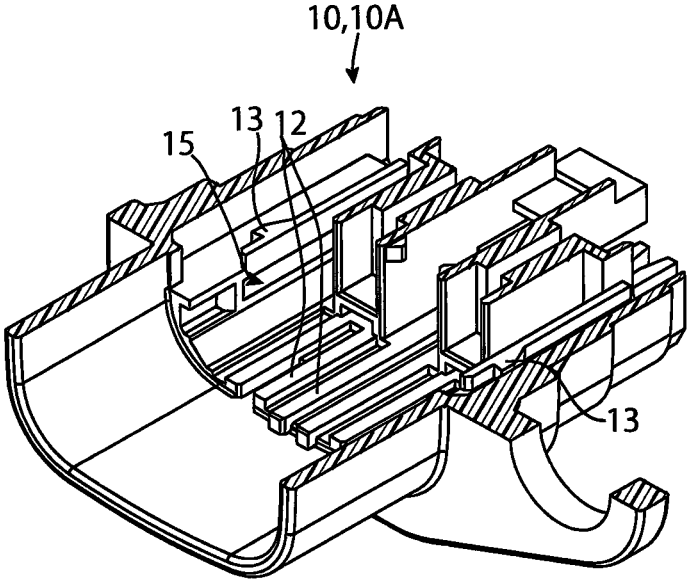
FIG. 5 is a perspective view of a front housing, cross-section in the same manner as in FIG. 2.

In addition, the right and left lock arms 35 are provided with disengagement protrusions 352 located forward of the abutting wall 32 and have projecting shapes (see FIGS. 3 and 4(B)). The disengagement protrusions 352 have a function of being pushed by the mating electrical connector 2 in the process of mating, thereby deflecting the lock arms 35 outward. When the lock arms 35 deflect outward, the engagement of the slidable-member-side engaging portions 351 with the housing-side engaging portions 13 is cancelled so that the slidable member 30 can slide rearward.

In this regard, the engagement arms 34 deflect outward in such a manner that the hook portions 341 are pushed by the engaging portions 201 of the second mating connector 2 in the process of mating when the slidable member 30 is located in the forward position. Then, the engaging portions 201 climb over the hook portions 341. The disengagement protrusions 352 of the lock arms 35 have not been pushed yet by the second mating connector 2 when the engaging portions 201 of the second mating connector 2 have just climbed over the hook portions 341. That is, at this moment, the lock arms 35 are not deflected yet, and the slidable-member-side engaging portions 351 are still engaged with the housing-side engaging portions 13. In other words, the engaging portions 201 of the mating electrical connector 2 climb over the hook portions 341 and become engaged therewith with the slidable member 30 locked in the forward position. When the mating electrical connector 2 is inserted further in the mating direction, then the disengagement protrusions 352 of the lock arms 35 are pushed by the mating electrical connector 2 and the lock arms 35 deflect. Thus, the engagement of the slidable-member-side engaging portions 351 with the housing-side engaging portions 13 are cancelled, so that the slidable member 30 becomes able to move to the rearward position. By continuing inserting the mating electrical connector 2 in the mating direction, the slidable member 30 slides to the rearward position and, accordingly, the tab terminals 20 project forward beyond the abutting wall 32 so as to be connected with the female terminals 202 of the mating electrical connector 2.

In addition, the slidable member 30 is provided with retention arms 36 (see FIGS. 4(A) and 4(B)) extending rearward in the form of cantilevers. The retention arms 36 have hook portions 361. The hook portions 361 enter into slots 15 (see FIG. 5) of the housing 10 and engage with front end faces of the slots 15 when the slidable member 30 is located in the forward position. Thus, the slidable member 30 is prevented from slipping off from the housing 10.

Furthermore, as shown in FIGS. 3, 4(A), and 4(B), the slidable member 30 is provided with temporary engagement arms 37. The temporary engagement arms 37 have distal end portions held between two protrusions 16 (see FIG. 8) provided side by side in the forward and rearward directions on the housing 10 in the middle of mating of the mating electrical connector 2 and in the middle of extraction thereof. Thus, a half-mating state of the electrical connector 1 and the mating electrical connector 2 due to temporary engagement is achieved.

Figure 6A:
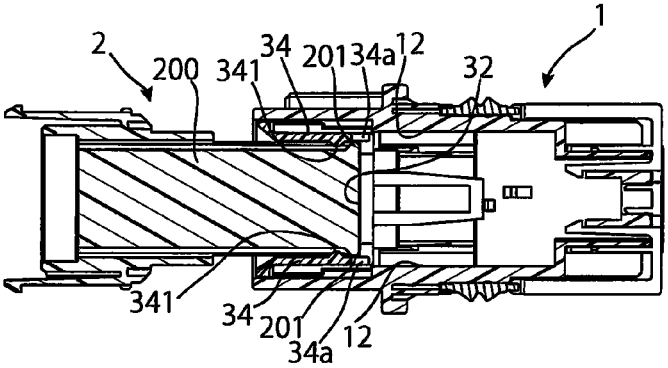
FIGS. 6(A), 6(B), and 6(C) are views sequentially showing actions during the mating of the mating electrical connector with the electrical connector in accordance with the present invention.
Figure 6B:
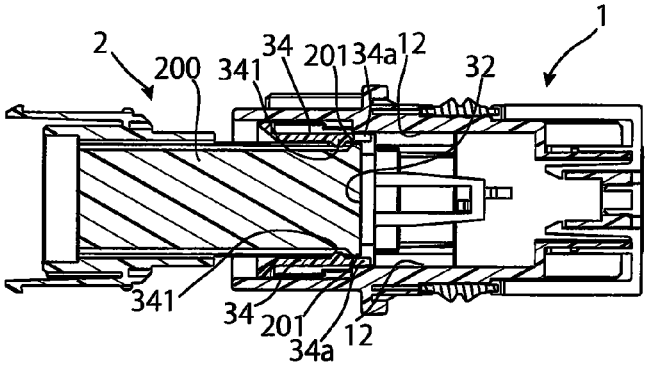
Figure 6C:
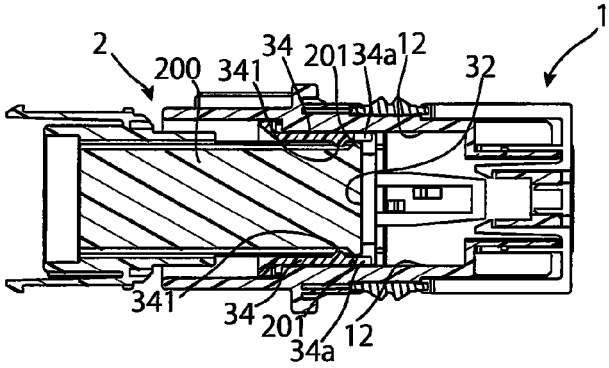

FIGS. 6(A), 6(B), and 6(C) are views sequentially showing actions during the mating of the mating electrical connector 2 with the electrical connector 1. It should be noted that FIG. 6(A), 6(B), and 6(C) are side views showing the electrical connector 1 and the mating electrical connector 2 in cross-section taken by a vertical plane cutting the hook portion 341 of the engagement arm 34. FIG. 6(A) is a view showing a state immediately after the mating electrical connector 2 advances in the mating direction and the mating electrical connector 2 abuts against the abutting wall 32 of the slidable member 30. In addition, FIG. 6(B) is a view showing a state in which the slidable member 30 is slightly pushed in by the mating electrical connector 2. Furthermore, FIG. 6(C) is a view showing a state in which the mating is completed.

In FIGS. 6(A) to 6(C), cross sections of the engagement arms 34 are shown. The engagement arms 34 extend rearward in the form of cantilevers and have widths tapering rearward. For this reason, free-end vicinity portions 34*a* extending rearward of the engagement arms 34 shown in FIGS. 6(A) to 6(C) are shown in non-cross-sectioned states.

In FIG. 6(A), the engaging portions 201 of the mating electrical connector 2 have already climbed over the hook portions 341 of the engagement arms 34 of the slidable member 30. That is, when the mating electrical connector 2 is mated, before the mating electrical connector 2 advances to the state shown in FIG. 6(A), the engaging portions 201 of the mating electrical connector 2 push the hook portions 341 to cause the engagement arms 34 to deflect outward, and climb over the hook portions 341. When the slidable member 30 is located in the forward position shown in FIG. 6(A), the engagement arms 34 are detached from the anti-deflection walls 12 (see also FIG. 5) along the entire lengths to their rear ends that are the free ends. For this reason, as the mating electrical connector 2 advances toward mating, the hook portions 341 are pushed by the engagement arms 201 of the mating electrical connector 2, so that the engagement arms 34 become able to deflect.

The slidable member 30 is slightly pushed in from the state shown in FIG. 6(A) to reach the state shown in FIG. 6(B). Then, portions on the free end sides of the engagement arms 34 overlap with the anti-deflection walls 12 of the housing 10 in the vertical direction, so that the engagement arms 34 are no longer able to deflect. Thereafter, the mating electrical connector 2 further advances toward the mating and finally reaches the state of complete mating shown in FIG. 6(C). At this time, the slidable member 30 is moved to the rearward position.

When the mating electrical connector 2 is extracted, these actions are reversed. That is, the extraction is started from the state of complete mating shown in FIG. 6(C). At the time of this extraction, during a period from the state shown in FIG. 6(C) to the state shown in FIG. 6(B), the engagement arms 34 are prevented from deflecting by the anti-deflection walls 12. This ensures that the hook portions 341 of the engagement arms 34 and the engaging portions 201 of the second mating connector 2 are kept engaged. Therefore, when the mating electrical connector 2 is extracted, the slidable member 30 reliably moves to the forward position according to the extraction.

When the mating electrical connector 2 is extracted to the position shown in FIG. 6(A), the engagement arms 34 are detached from the anti-deflection walls 12 along the entire lengths to their free ends and thus become able to deflect. After being extracted to the position shown in FIG. 6(A), the mating electrical connector 2 is further moved in the direction of extraction. Then, the hook portions 341 are pushed by the engaging portions 201 of the mating electrical connector 2 and thus the engagement arms 34 deflect and the engagement of the engaging portions 201 of the mating electrical connector 2 with the hook portions 341 is cancelled, so that the mating electrical connector 2 becomes able to be pulled out.

FIGS. 7(A), 7(B), 7(C), 8(A), 8(B), and 8(C) are views sequentially showing actions during the mating of the mating electrical connector 2 with the electrical connector 1, like FIGS. 6(A) to 6(C).

Figure 7A:
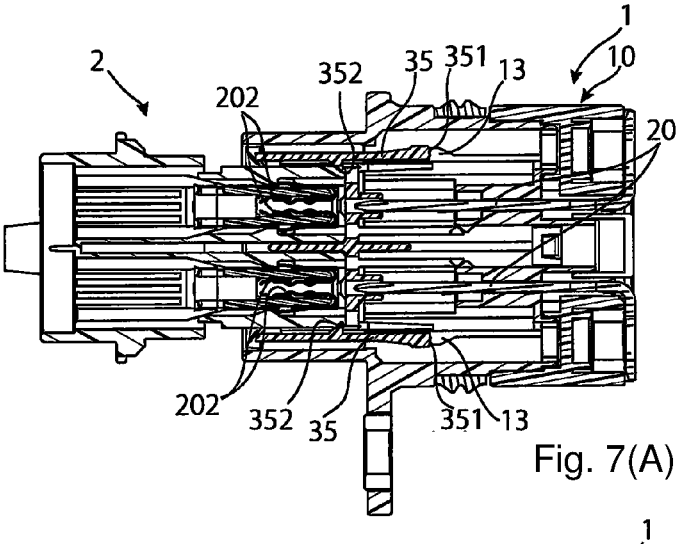
FIGS. 7(A), 7(B), and 7(C) are views sequentially showing actions during the mating of the mating electrical connector with the electrical connector in accordance with the present invention.
Figure 7B:
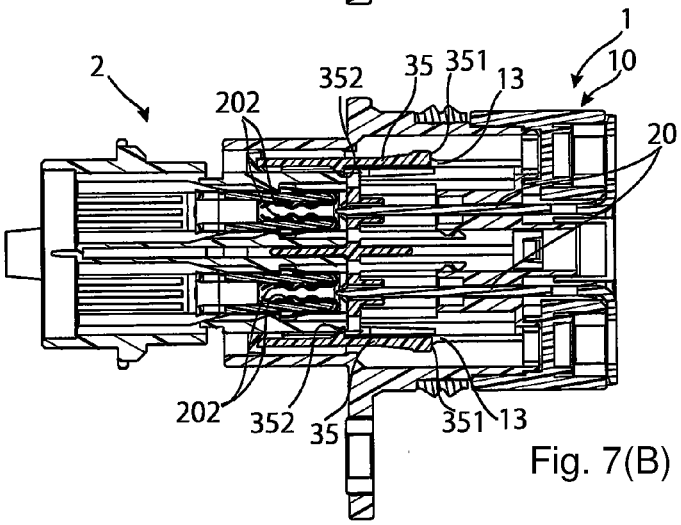
Figure 7C:
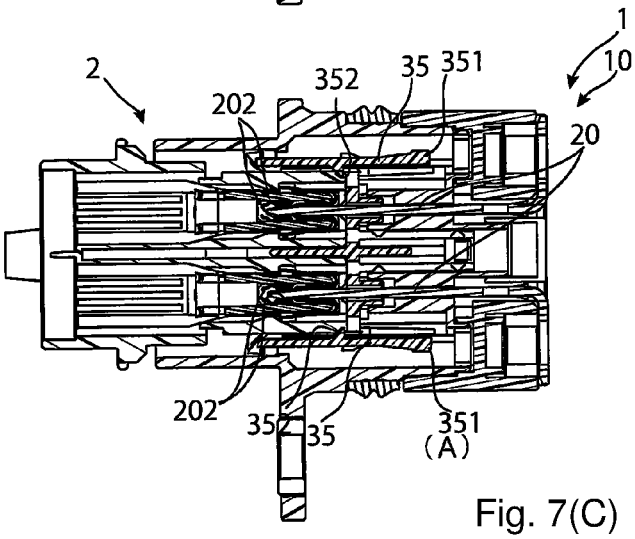

In this regard, FIGS. 7(A), 7(B), and 7(C) are plan views showing the electrical connector 1 and the mating electrical connector 2 in cross-section by a horizontal plane intersecting the center in the vertical direction. In addition, FIGS. 8(A), 8(B), 8(C) are plan views showing the electrical connector 1 and the mating electrical connector 2 in cross-section by a horizontal plane intersecting a portion slightly above the center in the vertical direction.

The actions of the lock arms 35 will be described below. The slidable-member-side engaging portions 351 provided in the lock arms 35 have vertically elongated shapes. The housing-side engaging portions 13 engaging with the slidable-member-side engaging portions 351 are not provided at the center in the vertical direction, but provided closer to the top and bottom than to the center. Therefore, in this regard, FIGS. 8(A), 8(B), and 8(C), which show cross-sections of the horizontal plane intersecting the housing-side engaging portions 13 provided closer to the top than to the center, will be referred to in combination with FIGS. 7(A), 7(B), and 7(C).

Figure 8A:
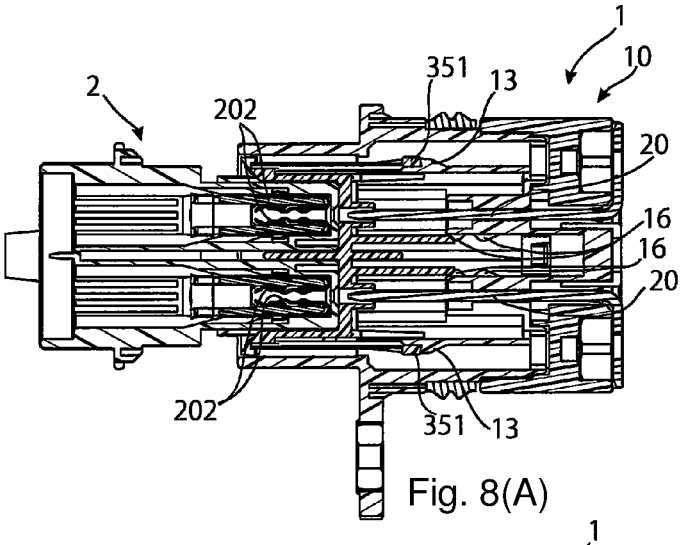
FIGS. 8(A), 8(B), and 8(C) are views sequentially showing actions during the mating of the mating electrical connector with the electrical connector in accordance with the present invention.
Figure 8B:
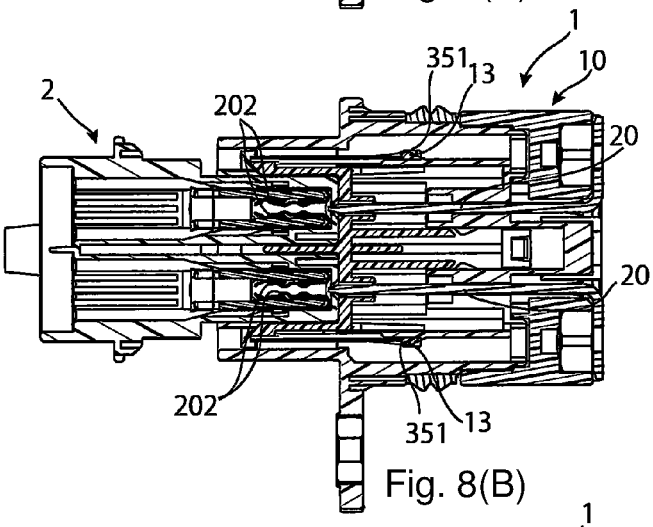
Figure 8C:
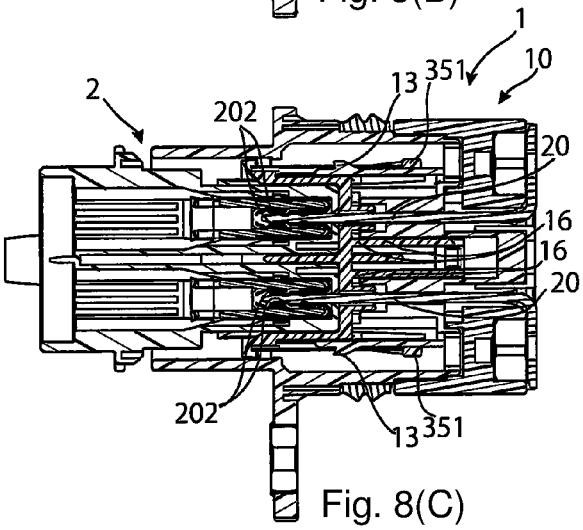

It should be noted that FIGS. 7(A) and 8(A) show a state in which the mating electrical connector 2 is mated to the same position as in FIG. 6(A). In addition, FIGS. 7(B) and 8(B) show a state in which the mating electrical connector 2 is mated to the same position as in FIG. 6(B). Furthermore, FIGS. 7(C) and 8(C) show a state that the mating electrical connector 2 is mated to the same position as in FIG. 6(C), namely, the state of complete mating.

When the mating electrical connector 2 is mated, as shown in FIG. 6(A), the engaging portions 201 of the mating electrical connector 2 have already climbed over the hook portions 341 of the engagement arms 34. However, as shown in FIGS. 7(A) and 8(A), in this stage, the slidable-member-side engaging portions 351 of the lock arms 35 remain engaged with the housing-side engaging portion 13.

When the mating electrical connector 2 is mated to the position shown in FIGS. 7(B) and 8(B), the mating electrical connector 2 pushes the disengagement protrusions 352 of the lock arms 35 and deflects the lock arms 35. Thus, the engagement of the slidable-member-side engaging portions 351 with the housing-side engaging portion 13 is cancelled. However, FIGS. 7(B) and 8(B) show the lock arms 35 in their free states before deflection. Therefore, in FIGS. 7(B) and 8(B), the slidable-member-side engaging portions 351 and the housing-side engaging portions 13 are drawn in the same position in an overlapping manner. However, this is merely a matter of illustration and actually the lock arms 35 are deflected, and the slidable-member-side engaging portions 351 are climbing over the housing-side engaging portions 13.

Thereafter, the mating electrical connector 2 is further moved in the mating direction to the state of complete mating shown in FIGS. 7(C) and 8(C). In this process, the tab terminals 20 of the electrical connector 1 are inserted into the female terminals 202 of the mating electrical connector 2 and an electrical conduction is established between the electrical connector 1 and the mating electrical connector 2.

When the mating electrical connector 2 is extracted, these actions are reversed. As the extraction of the mating electrical connector 2 advances from the state of complete mating shown in FIGS. 7(C) and 8(C), when the extraction reaches the state shown in FIGS. 7(B) and 8(B), the slidable-member-side engaging portions 351 of the lock arms 35 climb forward over the housing-side engaging portions 13 and additionally reach the state shown in FIGS. 7(A) and 8(A). When the mating electrical connector 2 is extracted to the state shown in FIGS. 7(A) and 8(A), the slidable-member-side engaging portions 351 of the lock arms 35 are securely engaged with the housing-side engaging portions 13. That is, when the extraction advances to the stage shown in FIGS. 7(A) and 8(A), the slidable member 30 is securely locked in the forward position. At this time, since the hook portions 361 of the slidable member engage with the front end faces of the slots 15 of the housing 10, the slidable member 30 is prevented from sliding forward. That is, the slidable member 30 is retained in the housing 10. On the other hand, as shown in FIG. 6(A), in this stage, the engaging portions 201 of the mating electrical connector 2 are still engaged with the hook portions 341 of the engagement arms 34. When the mating electrical connector 2 is further extracted from the state shown in FIG. 6(A), the engagements with the hook portions 341 are cancelled.

As described above, when the mating electrical connector 2 is mated, the engaging portions 201 of the mating electrical connector 2 are securely engaged with the hook portions 341 of the engagement arms 34 and then the lock to the forward position of the slidable member 30 by the lock arms 35 is cancelled. In addition, when the mating electrical connector 2 is extracted, the slidable member 30 is securely locked in the forward position by the lock arms 35 and then the engagement of the engagement arms 34 is cancelled. In this embodiment, this order is always reliably kept. Therefore, according to this embodiment, a highly-reliable electric shock prevention function is achieved.

It should be understood that various modifications may be made to the invention as described above that will remain within the scope of the invention. For example, suitable results may be achieved if the described techniques are performed in a different order and/or if components in a described system, architecture, device, or circuit are combined in a different manner and/or replaced or supplemented by other components or their equivalents. Accordingly, other implementations are within the scope of the following claims.

What is claimed is:

1. An electrical connector comprising:

a housing having:

(a) a hollow portion opened in a front side facing a mating electrical connector to be mated with the electrical connector, and (b) an anti-deflection portion;

a terminal supported by the housing and projecting forward into the hollow portion of the housing; and a slidable member:

(a) disposed in the hollow portion of the housing, (b) having an insertion hole in which the terminal is positioned, (c) slidable between:

(1) a forward position in which a front end of the terminal is in the insertion hole of the slidable member, and (2) a rearward position in which a portion of the terminal required for connection with a terminal of the mating electrical connector protrudes forward beyond the insertion hole, and (d) having:

(1) an abutting wall formed with an insertion hole being pushed by the mating electrical connector when the mating electrical connector advances toward a mating abuts against the abutting wall, (2) a front side wall extending forward beyond the abutting wall of the slidable member, and (3) an engagement arm:

(i) having a cantilever shape having on a front side a fixed end joined to the front side wall of the slidable member, (ii) having a hook portion adapted to engage the mating electrical connector when advancing toward the mating, so that when the mating electrical connector in a mating state is extracted, the engagement causes the hook portion of the engagement arm to be pulled by the mating electrical connector and the hook portion causes the slidable member to slide to the forward position, and (iii) deflectable when within the anti-deflection portion of the housing allowing the engagement arm to deflect when the slidable member is located in the forward position so that the mating electrical connector can climb over the hook portion and prevent deflection of the slidable member when the slidable member is located rearward of the forward position.

2. The electrical connector according to claim 1, wherein the slidable member further has a lock arm locking the slidable member in the forward position, and (a) the lock arm:

(1) has on a front side a fixed end joined to the front side wall, (2) extends rearward beyond the abutting wall in the form of a cantilever, (3) has a slidable-member-side engaging portion rearward of the abutting wall for engaging with the housing when the slidable member is located in the forward position, and (4) has a disengagement protrusion cancelling engagement of the slidable-member-side engaging portion with the housing-side engaging portion when the slidable member is located in the forward position by push by the mating electrical connector advancing toward the mating to cause the lock arm to deflect, and (b) the housing has a housing-side engaging portion for engaging with the slidable-member-side engaging portion when the slidable member is located in the forward position.

3. The electrical connector according to claim 2, wherein, according to the positional relationship of the hook portion and the disengagement protrusion, when the slidable member is located in the forward position, the engagement protrusion is pushed by the mating electrical connector advancing toward the mating, causes the lock arm to deflect, and cancels the engagement of the slidable-member-side engaging portion with the housing-side engaging portion, after the hook portion is pushed by the mating electrical connector, causes the engagement arm to deflect, and causes the mating electrical connector to climb over the hook portion.

* * * * *